US012104878B2

(12) United States Patent
Baumbach et al.

(10) Patent No.: US 12,104,878 B2
(45) Date of Patent: Oct. 1, 2024

(54) RIFLE STOCK

(71) Applicant: Springfield, Inc., Geneseo, IL (US)

(72) Inventors: Christopher Martin Baumbach, LeClaire, IA (US); Nick Ballard, Galva, IL (US); Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 82 days.

(21) Appl. No.: 17/449,102

(22) Filed: Sep. 28, 2021

(65) Prior Publication Data

US 2022/0099406 A1 Mar. 31, 2022

Related U.S. Application Data

(60) Provisional application No. 63/084,318, filed on Sep. 28, 2020.

(51) Int. Cl.

| | |
|---|---|
| ***F41C 23/18*** | (2006.01) |
| ***F41C 23/14*** | (2006.01) |
| ***F41C 23/20*** | (2006.01) |

(52) U.S. Cl.

CPC ..... *F41C 23/18* (2013.01); *F41C 23/14* (2013.01); *F41C 23/20* (2013.01)

(58) Field of Classification Search

CPC ..... F41C 23/18; F41C 23/14; F41C 23/00; F41C 27/00; F41A 11/00

See application file for complete search history.

(56) References Cited

U.S. PATENT DOCUMENTS

| | | | |
|---|---|---|---|
| 2,062,079 | A | 11/1936 | Russell |
| 4,674,216 | A | 6/1987 | Ruger et al. |
| 5,194,678 | A | 3/1993 | Kramer |
| 6,301,817 | B1 | 10/2001 | Hogue et al. |

(Continued)

FOREIGN PATENT DOCUMENTS

| | | |
|---|---|---|
| CN | 1039980 | 2/1990 |
| CN | 101469734 | 7/2009 |

(Continued)

OTHER PUBLICATIONS

Snow, Outdoor Life Website, Springfield Armory's Model 2020 Waypoint Is an Accurate New Hunting Rifle with Competition Features [online] Publication date Sep. 29, 2020, [retrieved on 2022—May 16, 2022]. Retrieved from the internet URL:.

(Continued)

*Primary Examiner* — J. Woodrow Eldred

(74) *Attorney, Agent, or Firm* — Woodard, Emhardt, Henry, Reeves & Wagner, LLP

(57) ABSTRACT

A stock assembly for a firearm including an integrally molded accessory attachment housing and a method of forming the accessory attachment housing. The integrally molded accessory attachment housing is formed by molding a material in the form of a stock assembly around the accessory attachment housing. A stock slot is formed through the material around the accessory attachment housing and an opening corresponding to the position of the stock slot is defined through the accessory attachment housing. The stock assembly may additionally or alternatively include a cheek riser that has an adjustable cheek rest. The cheek rest may be configured to be adjustable in at least four different directions including rotation.

20 Claims, 11 Drawing Sheets

(56) References Cited

U.S. PATENT DOCUMENTS

| | | | | |
|---|---|---|---|---|
| 6,647,653 | B1 | 11/2003 | Hengstenberg | |
| 6,658,781 | B1 | 12/2003 | Bowen | |
| 6,796,069 | B2 | 9/2004 | Hengstenberg | |
| D567,895 | S | 4/2008 | Cauley | |
| D639,891 | S | 6/2011 | Chvala | |
| D679,356 | S | 4/2013 | Klotz | |
| D695,377 | S | 12/2013 | Mayberry et al. | |
| 8,800,423 | B1 | 8/2014 | Lammers | |
| D725,215 | S | 3/2015 | Eberle | |
| D755,323 | S | 5/2016 | Eitan et al. | |
| D757,885 | S | 5/2016 | Barfoot et al. | |
| 10,260,838 | B1 * | 4/2019 | Kincel | F41G 11/003 |
| 10,371,475 | B2 | 8/2019 | Cook et al. | |
| D863,488 | S | 10/2019 | Korth et al. | |
| D868,190 | S | 11/2019 | Laney et al. | |
| D880,643 | S | 4/2020 | Weiss | |
| D882,015 | S | 4/2020 | Juarez | |
| D921,813 | S | 7/2021 | Kuz | |
| D925,688 | S | 7/2021 | Moretti | |
| D926,911 | S | 8/2021 | McLeroy et al. | |
| D926,912 | S | 8/2021 | McLeroy et al. | |
| D961,713 | S | 8/2022 | Lynch | |
| D963,099 | S | 9/2022 | Baumbach et al. | |
| D973,170 | S | 12/2022 | Martelli | |
| 2003/0093935 | A1 | 5/2003 | Huston | |
| 2006/0207152 | A1 | 9/2006 | Lazor | |
| 2007/0163162 | A1 | 7/2007 | Laney et al. | |
| 2008/0244951 | A1 | 10/2008 | Picard et al. | |
| 2009/0056191 | A1 | 3/2009 | Battaglia | |
| 2012/0023800 | A1 | 2/2012 | Laney | |
| 2015/0192384 | A1 | 7/2015 | Ballard | |
| 2015/0247700 | A1 | 9/2015 | Merlino et al. | |
| 2015/0285585 | A1 | 10/2015 | Hewes et al. | |
| 2015/0369558 | A1 | 12/2015 | Gottzmann | |
| 2016/0298925 | A1 | 10/2016 | Gottzmann et al. | |
| 2016/0305738 | A1 * | 10/2016 | Huang | F41C 23/20 |
| 2018/0058808 | A1 | 3/2018 | Gottzmann et al. | |
| 2018/0202760 | A1 | 7/2018 | Drake | |
| 2018/0259293 | A1 * | 9/2018 | Fiester | F41C 23/16 |
| 2019/0093984 | A1 * | 3/2019 | Lundbäck | F41C 23/14 |
| 2019/0285380 | A1 | 9/2019 | Washburn, III et al. | |
| 2022/0099406 | A1 | 3/2022 | Baumbach et al. | |

FOREIGN PATENT DOCUMENTS

| | | |
|---|---|---|
| CN | 103419556 | 12/2013 |
| EP | 0125735 A3 | 11/1984 |
| KR | 20070114377 | 9/2007 |
| WO | WO 2004020272 | 3/2004 |

OTHER PUBLICATIONS

Accurize Your Ruger, Victor Company Titan Stock, Retrieved from Internet Oct. 27, 2020.

American Hunter, Synthetic stocks vs. Wood. Retrieved Jun. 9, 2021 https://www.americanhunter.org/articles/2018/2/27/stocks-synthetic-vs-wood/.

American Rifleman, Back-to-Basics Rifle Stocks, Retrieved from Internet Oct. 27, 2020.

English Translation of CN 103419556.

English Translation of CN 1039980.

English Translation of CN101469734.

English Translation of KR 20070114377.

Hardware Option for Your McMillan Stock, Retrieved from YouTube on Apr. 26, 2021, https://www.youtube.com/watch?v=cTR4hO9Infg.

McMillan USA, Clalmpbar Adjustable Cheeck Piece. Retrieved Apr. 26, 2021 https://mcmillanusa.com/product/mcmillan-clampbar-adjustable-cheek-piece/.

Mens Interest Magazine, Synthetic Rifle Stocks. Retrieved Apr. 26, 2021. https://www.magzter.com/article/Mens-Interest/Rifle/Synthetic-Rifle-Stocks.

C. L. Mossberg adds the new patriot LR tactical to the bolt-action lineup. The Firearm Blog. Retrieved from the internet on Jun. 20, 2023, URL <https://www.thefirearmblog.com/blog/2023/01/12/mossberg-patriot-lr-tactical/.

Moss, M. WoOX introduces exactus precision rifle stock. The Firearm Blog. Retrieved from the internet On Jun. 20, 2023, URL <https://www.thefirearmblog.com/blog/2020/04/23/woox-introduces-exactus-precision-rifle-stock/.

* cited by examiner

RIFLE STOCK

CROSS REFERENCE TO RELATED APPLICATIONS

The present patent document claims the benefit of the filing date of Provisional U.S. Patent Application No. 63/084,318, filed on Sep. 28, 2020, which is hereby incorporated by reference in its entirety.

BACKGROUND

The present invention pertains generally to firearms and, in particular aspects, to a stock assembly for a firearm. In one aspect, the stock assembly includes an accessory rail. In another aspect, the stock assembly may include a cheek riser that includes an adjustable cheek rest.

Accessory rails provide a method of attaching accessories to a firearm. By standardizing the format of attachment to the accessory rail, many different varieties of accessories may be attached using the same rail, making customization of a firearm a relatively easy process. Despite the advantages offered by an accessory rail, the rail can add weight and/or increase the overall dimensions of the firearm. This increase in weight and/or size may make the firearm more difficult to carry and/or operate.

A cheek riser is typically positioned near the buttstock of a rifle and provides a user with a place to index their cheek or the side of their face while aiming the rifle. The cheek riser may improve accuracy by increasing stability of the head and neck and/or provide improved comfort. The cheek riser allows a user to adjust the height of their head with respect to the rifle so that the user may comfortably use an aiming device (e.g., look through a scope) while operating the firearm. It may be desirable to make the cheek riser adjustable to accommodate different users, different scopes, different scope mounts, or differing use conditions (e.g., shooting positions). Although some cheek risers may be adjustable in height, they may be difficult to adjust to provide an optimal fit for the user.

Thus, there is a need for improvement in this field.

SUMMARY

In certain embodiments, a stock for a firearm includes a first material molded at least partially around an accessory attachment housing comprising a second material. The accessory attachment housing includes a sidewall defining at least a portion of an internal cavity of the accessory attachment housing. The sidewall has an inward-facing surface that faces the internal cavity, an outward-facing surface that opposes the inward-facing surface, and a thickness extending from the inward-facing surface to the outward-facing surface. The sidewall defines a sidewall opening that extends through the thickness, and the sidewall opening has a width less than a corresponding width of the internal cavity.

In some embodiments, the first material of the stock covers the outward-facing surface of the accessory sidewall of the accessory attachment housing. However, the internal cavity of the accessory attachment housing is free of the first material of the stock. In some embodiments, the first material may be a synthetic polymer, while the second material of the accessory attachment housing may be a metal. In other embodiments, the first material is a laminate construct that may comprise one or more layers of a woven material. The one or more layers of woven material may comprise fiberglass and/or carbon fiber.

In some embodiments, the accessory attachment housing may have a polygonal cross-section. The sidewall opening that extends through the sidewall of the accessory attachment housing is defined by a planar sidewall of the accessory attachment housing. In some examples, the sidewall opening may define a length less than a corresponding length of the internal cavity of the accessory attachment housing. In some embodiments, the sidewall opening is non-circular. In some examples, the sidewall opening is an elongate opening and/or may be an M-LOK® opening.

In certain embodiments, a method of forming a component for a firearm includes positioning a hollow accessory attachment housing having an interior cavity into a mold. This component for a firearm may be a firearm stock. A first material is molded around the hollow accessory attachment housing. The first material may comprise carbon fiber. The accessory attachment housing may comprise a metal. In some embodiments, the molding does not fill the interior cavity of the hollow accessory attachment housing with the first material. The method may include forming at least one opening through a sidewall and into the interior cavity of the hollow accessory attachment housing. The at least one opening has a width that is less than a corresponding width of the interior cavity of the accessory attachment housing.

In some embodiments, the forming at least one opening through the sidewall occurs after molding the first material around the hollow accessory attachment housing. Additionally, some embodiments may also include forming at least one opening the first material. The forming at least one opening through the first material may occur prior to forming the at least one opening through the sidewall. The forming at least one opening in the sidewall may include milling the sidewall. The opening may be an M-LOK® opening. In some embodiments, the least one opening through the first material aligns with the at least one opening of the sidewall of the hollow accessory attachment housing so as to allow access through the first material and the sidewall into the interior cavity of the hollow accessory attachment housing.

In certain embodiments, a stock assembly for a firearm includes a buttstock and a cheek riser including a cheek rest. The cheek rest is attached to a cheek rest base, which is attached to at least one riser post. The at least one riser post is attached to the buttstock. The cheek rest of the cheek riser is configured for translation in a first direction relative to the cheek rest base. The cheek rest base is configured for translation in a second direction relative to the at least one riser post. The at least one riser post is configured for translation in a third direction relative to the buttstock. The first direction is transverse to the second direction and the third direction, and the second direction is transverse to the third direction.

In some embodiments, the first direction is parallel to a barrel axis of the firearm. The first direction and the second direction may be orthogonal to the third direction. The first direction may be orthogonal to the second direction. The cheek rest base may be at least partially rotatable around the third direction.

In some embodiments, a fastener securing the cheek rest to the cheek rest base has a head positioned on a side of the cheek rest base opposite a side of the cheek rest base facing the cheek rest. The fastener securing the cheek rest to the cheek rest base extends through an elongate slot defined by the cheek rest base. In some embodiments, the cheek rest base has a length, a width, and a thickness, and the length of the cheek rest base is greater than the width of the cheek rest base, while the width is greater than the thickness. The elongate slot that receives the fastener that secures the cheek rest to the cheek rest base has a greatest dimension extending along the length of the cheek rest base.

In some embodiments, a fastener securing the at least one riser post to the cheek rest base has a head positioned on a side of the cheek rest base opposite a side of the cheek rest base facing the at least one riser post. The fastener securing the at least one riser post to the cheek rest base extends through an elongate slot defined by the cheek rest base. The elongate slot receiving the fastener securing the cheek rest base to the at least one riser has a greatest dimension extending along the width of the cheek rest base. In some examples, the head of the fastener securing the at least one riser post to the cheek rest base has a polygonal periphery with at least two parallel sides. The cheek rest base may define a slot for receiving the head of the fastener securing the at least one riser post to the cheek rest base. The slot has a width approximately equal to a distance between the at least two parallel sides of the head.

The at least one post may extend through a buttstock insert that includes a clamp that is configured to selectively resist movement of the at least one riser post relative to the buttstock insert. The buttstock insert may be secured within the buttstock of the stock assembly.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
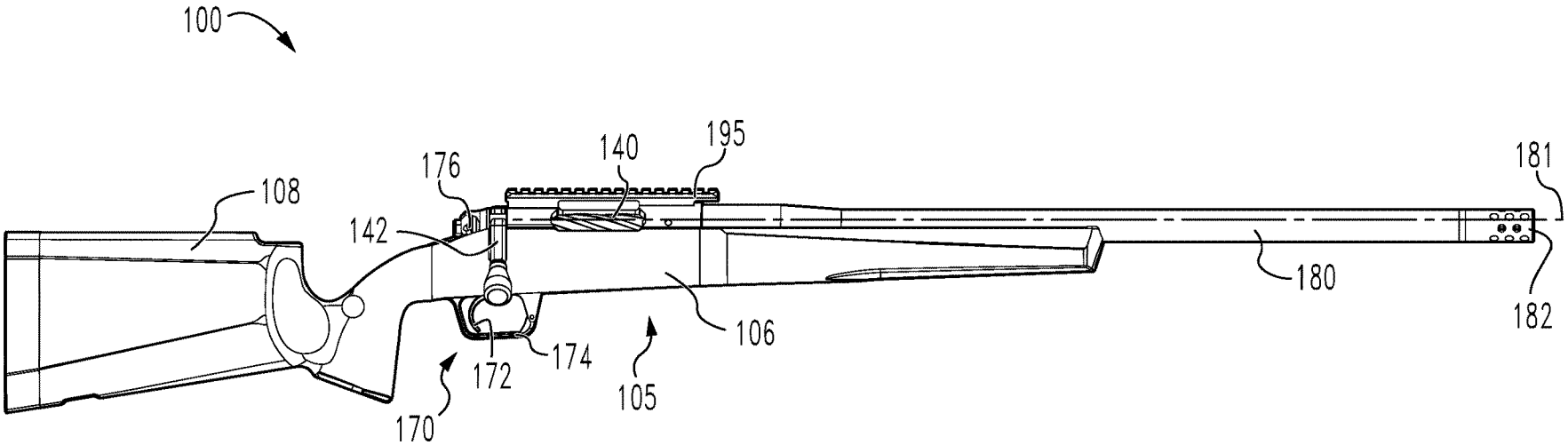
FIG. 1 is a right side view of a firearm.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., are used in this description with reference to the specific embodiment shown and used for purposes of clarity. It should be recognized that these terms are not meant to be limiting.

FIG. 1 illustrates a firearm 100. In the embodiment shown, the firearm 100 is a rifle and more particularly a bolt-action rifle. The present invention, however, may be used with any rifle (e.g., semi-automatic or muzzle-loader rifles) and shotgun. Firearm 100 includes a stock assembly 105 that includes a body 106 and a buttstock 108 that extends rearwardly therefrom. The buttstock 108 may be integrally formed with the body or may be formed separately and attached thereto. A receiver 130 is positioned within the body 106 of the stock assembly 105. A bolt 140 is housed within the receiver 130, and a bolt handle 142 extends outside of the receiver 130 to allow manual operation (e.g., reciprocation) of the bolt 140.

Firearm 100 includes a trigger assembly 170 having a trigger 172 that projects from the underside of the body 106. A trigger guard 174 surrounds the trigger 172 to resist inadvertent actuation of the trigger 172. The trigger assembly 170 also includes a trigger safety lever 176 that protrudes from the body 106 as an additional safety feature to resist inadvertent firing of the firearm 100. Trigger assembly 170 may be included as a portion of receiver 130.

A barrel 180 is affixed to and extends forward from the receiver 130. The barrel 180 includes a rifled bore 184 (see FIG. 2) and defines a barrel axis 181 extending longitudinally therethrough. The barrel 180 is supported by the body 106 of the stock assembly 105. In some embodiments, a muzzle brake 182 may be positioned at the forward end of the barrel 180. The muzzle brake 182 may be used to redirect propellant gases created during firing of the firearm 100 to counteract recoil and/or muzzle rise.

An accessory rail 195 may be attached to the receiver 130 above the bolt 140 to provide a location to attach any desired accessories, such as a scope, to the firearm 100. In the embodiment shown, the accessory rail 195 takes the form of a Picatinny rail; however, in other embodiments, any variety of rail interface system suitable for attaching accessories to a firearm may be used.

Figure 2:
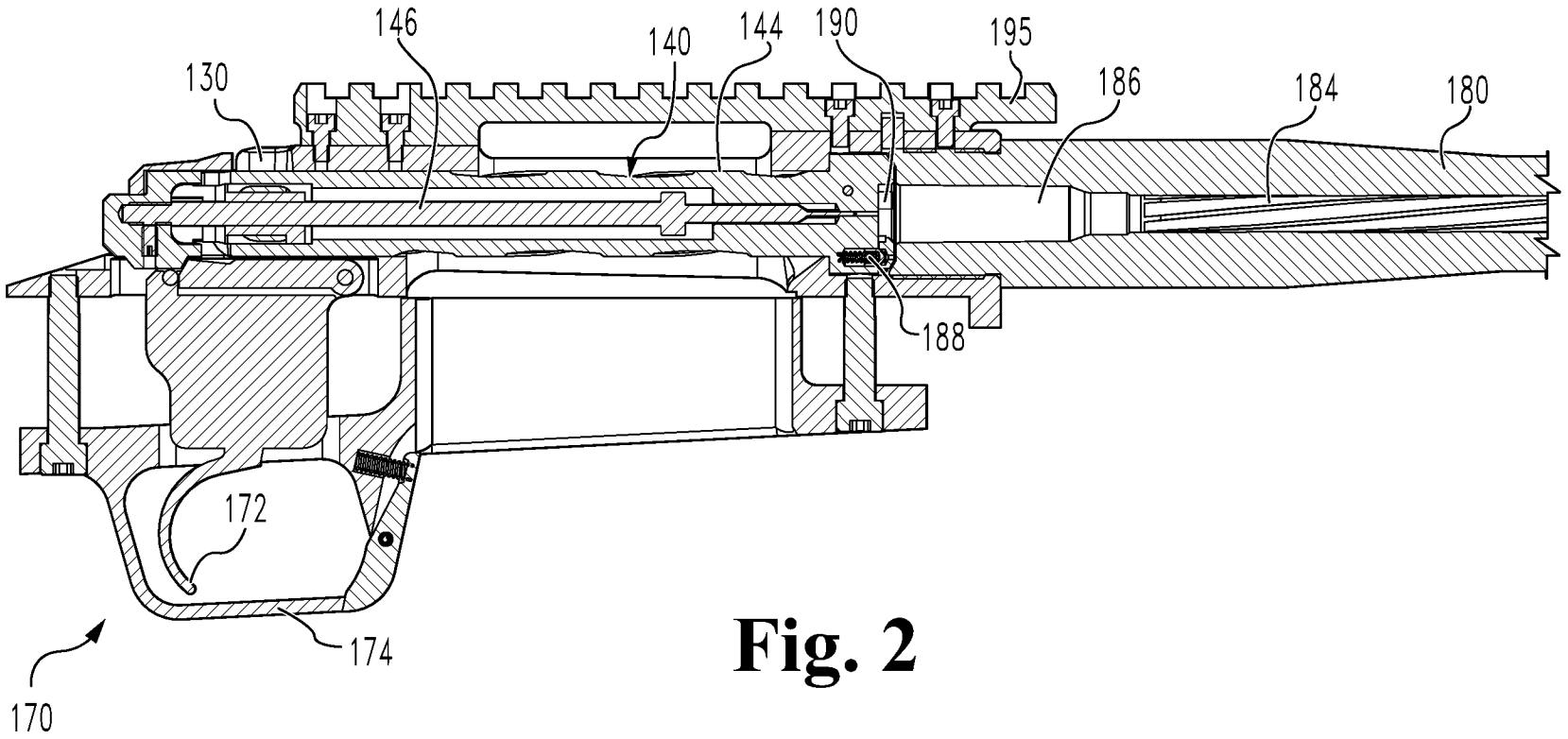
FIG. 2 is a partial cross-sectional view of the firearm of FIG. 1.

A cross-sectional view of a portion of the firearm 100 is shown in FIG. 2. As shown, the bolt 140 includes a bolt push feed 144 that surrounds a firing pin 146. The firing pin 146 fits concentrically within a firing pin spring (not shown). The firing pin 146 is translatable within the bolt push feed 144 so that the firing pin 146 can extend towards a chamber 186 of the barrel 180 of the firearm 100. The chamber 186 is configured to hold a cartridge having a bullet, a casing, and a primer. The bullet is fired from the cartridge by the firing pin 146 striking the primer and causing propellant (e.g., a powder charge within the cartridge) to ignite. An extractor 188 is located between the bolt 140 and the barrel 180 and operates to remove spent cartridge casings from the chamber 186 after the bullet from the cartridge has been fired. An ejector 190 then ejects the spent casing from the firearm 100.

Figure 3:
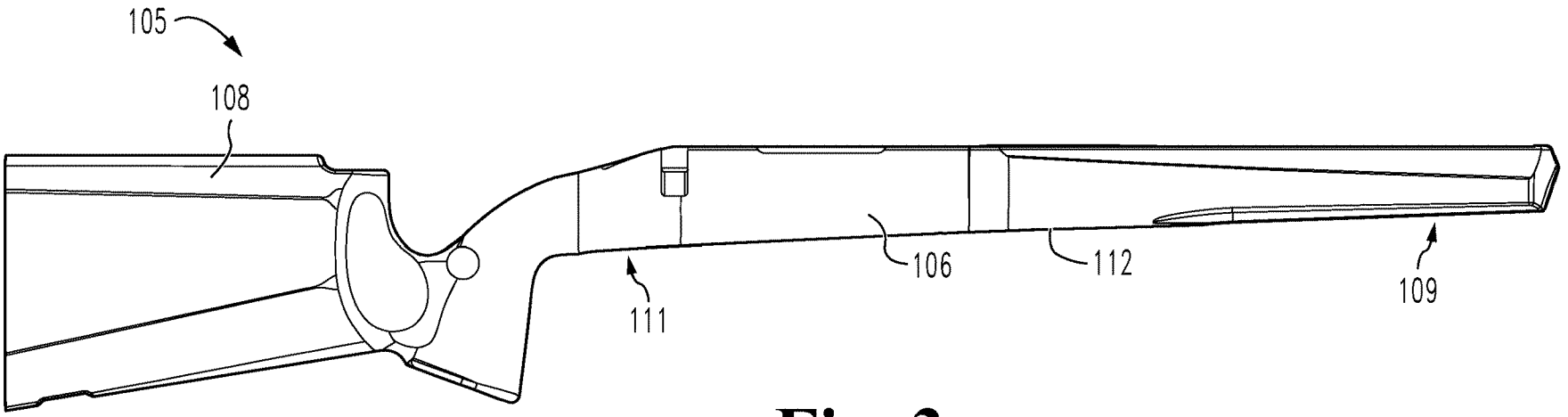
FIG. 3 is a right side view of a stock assembly of the firearm of FIG. 1.

FIG. 3 illustrates a side view of the stock assembly 105. In the embodiment shown, the buttstock 108 is integral to the body 106; however, in any embodiments, the buttstock 108 and the body 106 may be separate pieces that are attached together to form the stock assembly 105. The stock assembly 105 of the firearm 100 may be made from a synthetic polymeric or composite material such as carbon fiber. In some embodiments, the stock assembly 105 may be formed from a laminate construct. This laminate construct may include one or more layers of a woven material, such as fiberglass or carbon fiber. As illustrated, the body 106 includes a forward portion 109 and a rearward portion 111. The forward portion 109 provides an area for supporting the firearm 100 preferably without directly contacting the barrel 180. The rearward portion 111 provides support for the receiver 130 and an opening for a portion of the trigger assembly 170. Additionally, as shown in FIG. 3, the body 106 includes a bottom surface 112 that forms the underside of the body 106.

Figure 4:
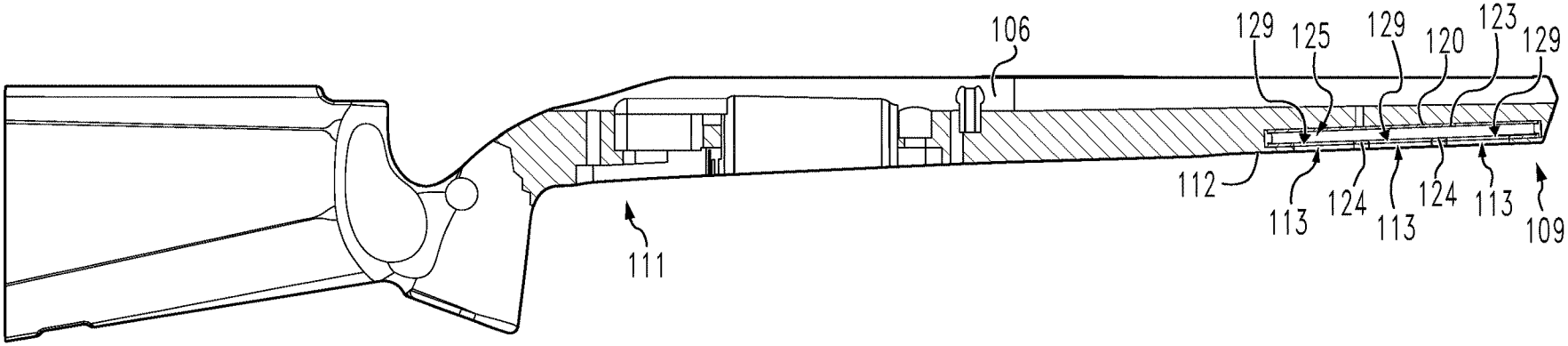
FIG. 4 is a cross-sectional view of the stock assembly of FIG. 3.

A cross-sectional view of the stock 104 is shown in FIG. 4. An accessory attachment housing 120 is included in the forward portion 109 of the body 106. The accessory attachment housing 120 includes structure for attaching accessories to the body 106 of the firearm 100 and may be made from metal or any other suitable material. The accessory attachment housing is preferably formed of a different material than that of the body 106; however, it could be the same material.

The accessory attachment housing 120 preferably includes an interface system for attaching attachments to the firearm, such as an M-LOK® or MOE slot as marketed by MagPul Industries or a KeyMod slot as marketed by VLTOR Weapon Systems and Noveske Rifleworks. However, in other embodiments, other suitable interface systems that are capable of securing and/or attaching to accessories to the firearm may be used, such as a Picatinny rail. The description provided below is specifically directed to an accessory attachment housing 120 that is an M-LOK® rail interface system, but it should be recognized that it is not limited to such and that other types of attachment mechanisms may be substituted in other embodiments.

Figure 5:
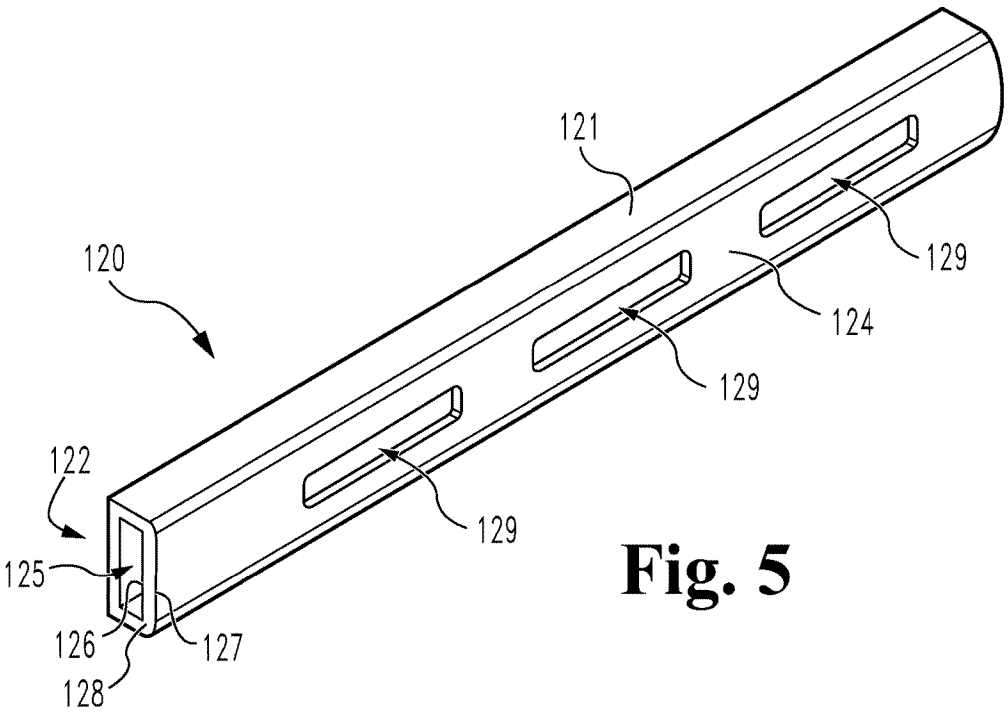
FIG. 5 is a bottom perspective view of an accessory attachment housing of the stock assembly of FIG. 3.

As shown in the bottom perspective view of the accessory attachment housing shown in FIG. 5, the accessory attachment housing 120 is a hollow, metal bar that includes sidewalls that form a polygonal cross-section. In particular, in FIG. 5, the sidewalls form a rectangular cross-section. However, in other embodiments, different shapes or materials may be used for the accessory attachment housing 120 that allow different accessories to be attached to the firearm 100.

The sidewalls of the embodiment of accessory attachment housing 120 that is shown in FIG. 5 include side sidewalls 121, a top sidewall 123 (see FIG. 4), and a bottom sidewall 124. A side edge 122 is formed at each end of the accessory attachment housing 120. The sidewalls define an internal cavity 125 that extends at least partially along the length of the accessory attachment housing 120. Each of the sidewalls includes an inward-facing surface 126 that faces the internal cavity 125 and an outward-facing surface 127 that opposes the inward-facing surface 126. A thickness 128 of each sidewall extends between the inward-facing surface 126 and the outward-facing surface 127.

At least one sidewall opening 129 is defined through at least one of the sidewalls. In some embodiments, the sidewall openings 129 are defined through a planar sidewall. As an example, in the embodiment shown in FIG. 5, the sidewall openings 129 are defined through the thickness 128 of bottom sidewall 124. Each of the sidewall openings 129 has a width that is smaller than the width of internal cavity 125 of the accessory attachment housing 120. The sidewall opening 129 into internal cavity 125 has inward-facing surface of the sidewall defining the sidewall opening extending along at least one edge of the sidewall opening. Preferably, the inward-facing surface extends along at least two sides of the sidewall opening, and more-preferably along at least two opposites sides of the sidewall opening. In some instances, the sidewall opening into the internal cavity is surrounded by inward-facing surface of the sidewall defining the sidewall opening. The sidewall opening 129 preferably has a length that is shorter than the length of the internal cavity 125.

The sidewall openings 129 are designed to receive fasteners for securing an accessory to the accessory attachment housing 120. In some embodiments, the sidewall openings 129 are part of the M-LOK® interface system and are designed to receive corresponding T-nuts that used to attach accessories in an M-LOK® system. Corresponding slots may be machined through material of body 106 adjacent to the accessory attachment housing 120 so that a user has access to the sidewall openings 129 for securing accessories to the body 106.

Figure 6:
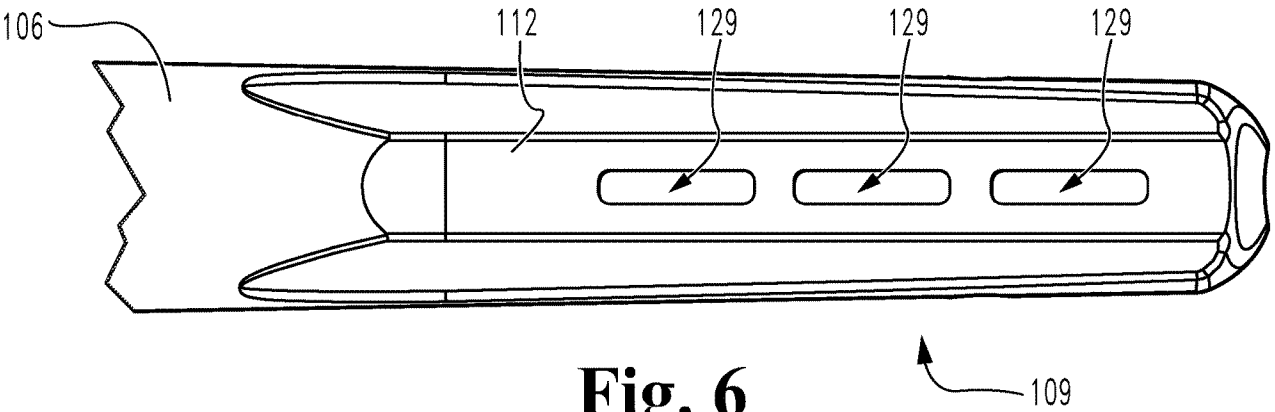
FIG. 6 is a partial bottom view of the stock assembly of FIG. 3.

A bottom view of the forward portion 109 of the body 106 is illustrated in FIG. 6. The bottom surface 112 of the body 106 is clearly shown in this bottom view. As shown in FIG. 6 and in FIG. 4, stock slots 113 correspond to the position of the sidewall openings 129. The stock slots 113 extend through the bottom surface 112 of the body 106, and when aligned with the sidewall openings 129 that extend through the bottom edge 124 of the accessory attachment housing 120, the sidewall openings 129 are exposed through the body 106 and capable of receiving an accessory to be attached to the stock assembly 105.

As shown in FIG. 6, the synthetic polymeric or composite material that is used to form the stock assembly 105 preferably does not cover the entirety of the sidewall openings 129 that are defined through accessory attachment housing 120. Additionally, the synthetic polymeric or composite material preferably does not fill the internal cavity 125 of the accessory attachment housing 120. This allows an attachment or a portion of an attachment to be inserted through a sidewall opening 129 or multiple sidewall openings 129 to be attached to the accessory attachment housing 120.

In some embodiments, the accessory attachment housing 120 may include a covering on the side faces 122 to prevent the synthetic polymeric material or the composite material used to form the stock assembly 105 from entering or filling the internal cavity 125. The covering may be permanent or removable. In one embodiment, the covering may be endcaps made from plastic, metal, or any other suitable material fit onto side faces 122 to cover the opening to internal cavity 125. In other cases, the covering may be tape or another type of material that is capable of preventing the synthetic polymeric material or composite material from entering internal cavity 125.

In accordance with the standard for the M-LOK® interface system, the sidewall openings 129 have a rectangular outline, possibly with rounded corners. Also according to the publically available M-LOK® standard, the sidewall openings 129 have a length of approximately 32 mm and a width of approximately 7 mm, and there is a distance of approximately 8 mm between adjacent sidewall openings 129. As discussed above, the sidewall openings 129 are adapted to receive a cammed T-nut that is initially aligned with a corresponding sidewall opening 129 and then turned 90 degrees to lock the T-nut within the sidewall opening 129. An accessory mounted to the accessory attachment housing 120 may be attached using a single T-nut or may include multiple T-nuts. Multiple T-nuts may be inserted through the same opening or each mounted in a corresponding sidewall opening 129 so that the accessory spans multiple sidewall openings 129. Although the embodiment shown in FIG. 5 has three sidewall openings 129, other embodiments may include more slots or fewer slots as desired.

Figure 7:
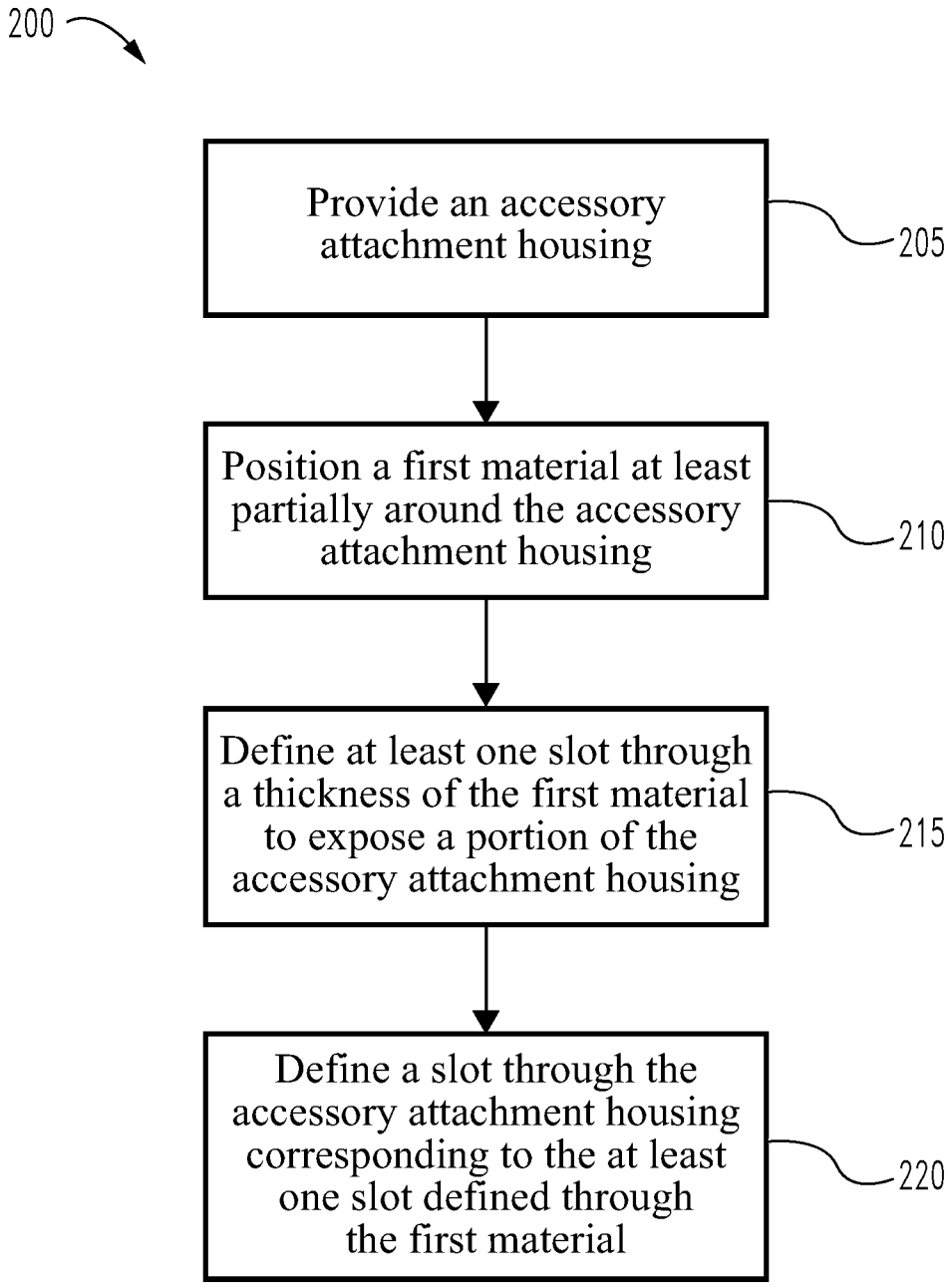
FIG. 7 is a flowchart for a method of forming an integrally molded accessory attachment housing.

A method of forming an integrally molded accessory attachment housing is illustrated in the flowchart 200 shown in FIG. 7. In a first stage 205, an accessory attachment housing is provided. The accessory attachment housing may be provided by producing or machining the accessory attachment housing, by purchasing a premade accessory attachment housing from a third party vendor, or any other suitable method of creating or procuring an accessory attachment housing. In some embodiments, the accessory attachment housing may be a molded and/or extruded metal housing that has a rectangular cross-section and defines a hollow interior. The accessory attachment housing may or may not include an opening in a sidewall.

In a second stage 210, a material for the body of the stock (e.g., synthetic polymeric and/or composite material) is positioned around the accessory attachment housing to form a stock assembly for a firearm, such as by molding—injection or otherwise. In one example, the body material may include carbon fiber, but in any embodiment, the material may include synthetic polymer and/or composite. Preferably, the body material differs from the material of the accessory attachment housing. For example, the accessory attachment housing may be metal and the body material may be non-metal. Preferably, the body material is positioned around the accessory attachment housing so the body material contacts the accessory attachment housing on the top, bottom and sides. Preferably, the thickness of body material between the accessory attachment housing and the bottom surface 112 of the body 106 is less than the thickness of body material forward, aft, and/or lateral of the accessory attachment housing.

In a third stage 215, at least one stock slot is defined through the body material at least to a depth that is sufficient to reach the accessory attachment housing. The slot may be formed by machining (e.g., drilling and/or milling) and/or molding-in or any other suitable method for forming an opening through the body material that is used to form the stock. In an optional fourth stage 220, an attachment housing slot that corresponds to the at least one stock slot formed through the body material may be formed through the accessory attachment housing. The attachment housing slot may be formed using the same method used to form the stock slot in the body material or may be formed using a different suitable method.

In some embodiments, an indicia may be positioned (e.g., by laser etching) on an interior and/or exterior surface of the accessory attachment housing 120 (e.g., on the inward-facing surface of the top sidewall of the accessory attachment housing). The indicia may include an identification number, such as a serial number, or may provide other information to the user. For example, the identification marking may be an identifier corresponding to an accessory attachment housing 120 interface, e.g., an M-LOK® interface. Other identifying information of the accessory attachment interface and/or firearm, such as a manufacturer name, product name, and/or a logo or any other desired information may be positioned on the accessory attachment housing.

Advantageously a hollow accessory attachment housing 120 molded into the stock assembly 105, provides relief on the inside of the accessory attachment housing for the attachment nut(s) (e.g., T-nuts) to be inserted into the sidewall opening 129 and eliminates the need for machining relief on the inside of the accessory attachment housing. Additionally, the accessory attachment housing 120 can provide a metal backing to support the body material of the stock assembly 105 and potentially resist delamination of composite material. Additionally, the disclosed accessory attachment housing can fit within the overall dimension of the stock and, therefore, may not add to the size of the firearm.

Accessories may be attached to the accessory attachment housing 120 by inserting a portion of the accessory that is designed to cooperate with the accessory attachment housing 120 through the stock slot 113 defined through the bottom surface 112 of the body 106. The portion of the accessory that is inserted through stock slot 113 is then inserted through a corresponding sidewall opening 129. The accessory is then attached to the accessory attachment housing 120, for example, by rotating a fastener (e.g., T-nut) of the accessory by a quarter turn so that a portion of the accessory inserted into the stock slot 113 and the sidewall opening 129 is blocked from being removed from the sidewall opening 129 and the stock slot 113.

Figure 8:
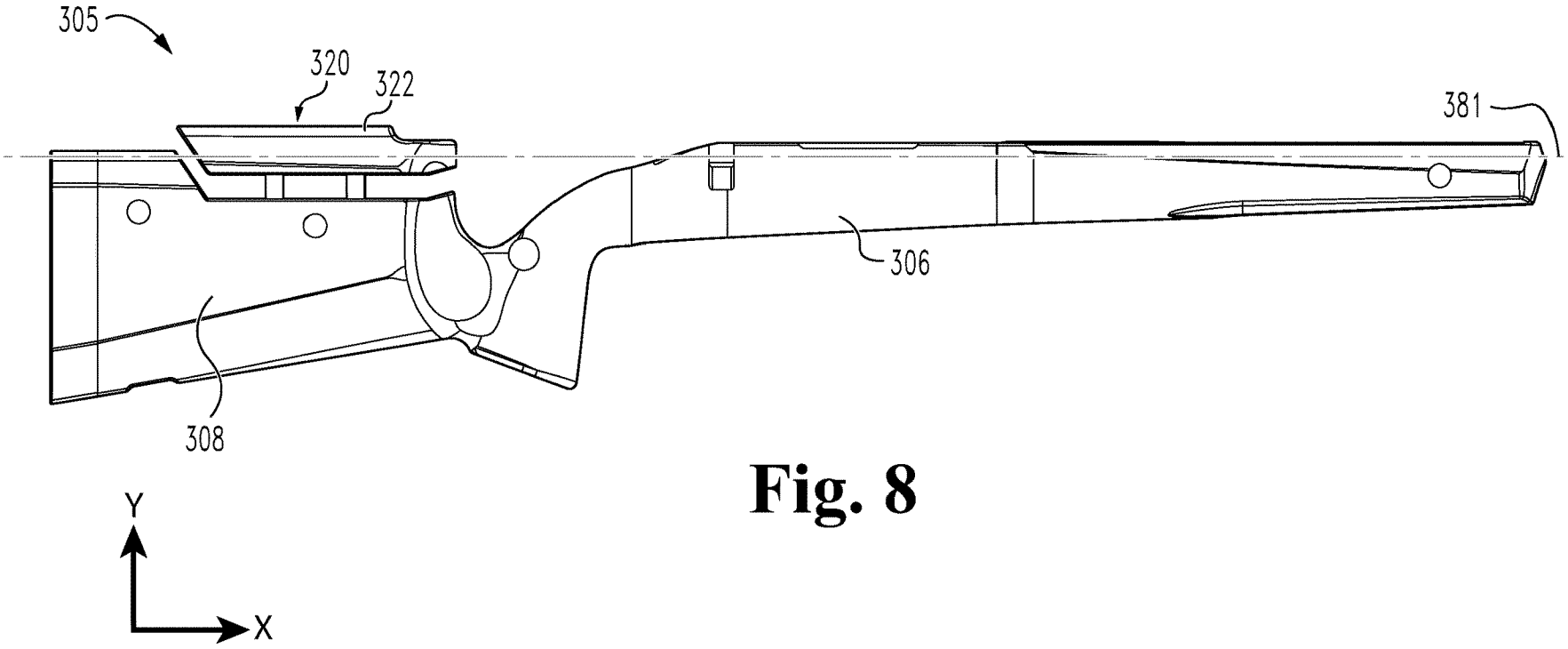
FIG. 8 is a side view of an embodiment of a stock assembly for a firearm.
Figure 9:
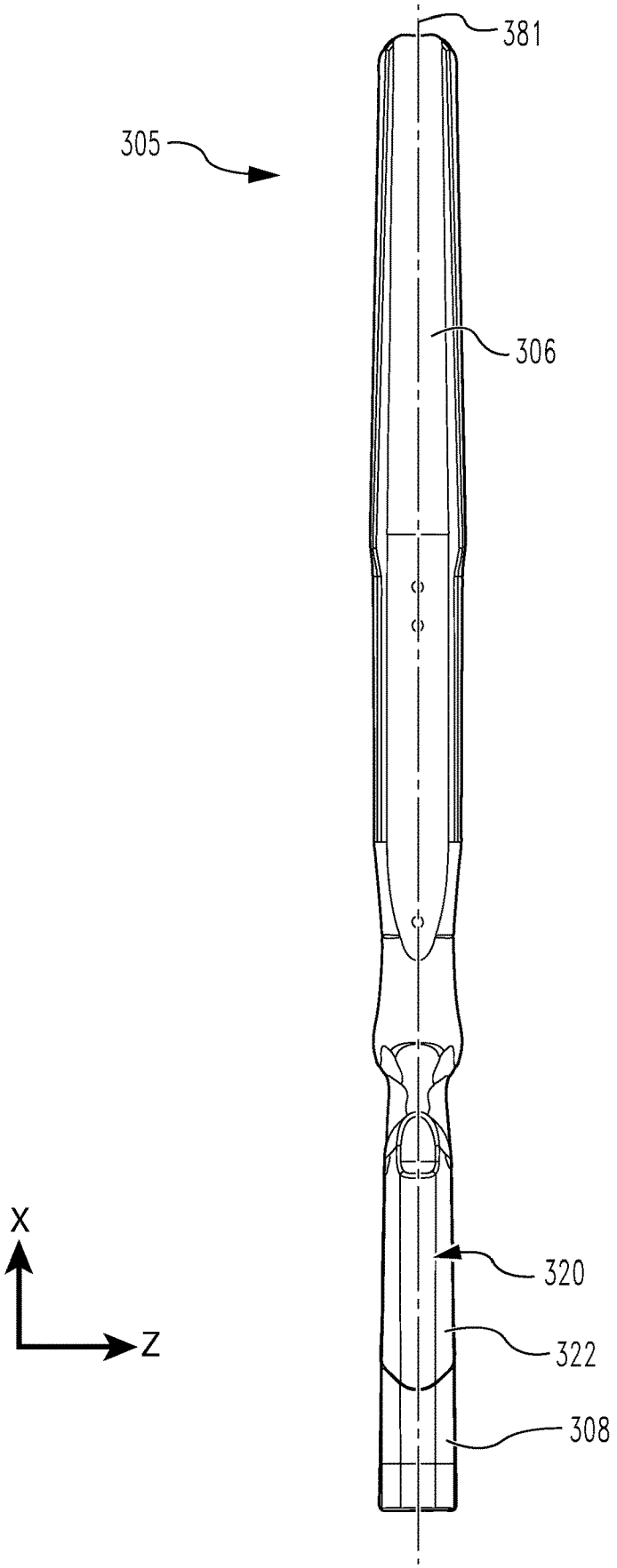
FIG. 9 is a top view of the stock assembly of FIG. 8

Another feature of a stock assembly 305 is illustrated in FIG. 8. A top view of the embodiment of the stock assembly 305 is shown in FIG. 9. The stock assembly 305 includes a body 306 and a buttstock 308 that can be integrally formed with the body 306. The stock assembly 305 includes a cheek riser 320 on an upper portion of the buttstock 308 and that includes an adjustable cheek rest 322. For simplicity, a barrel is not shown in FIG. 8 or in FIG. 9, however, it will be appreciated that a barrel axis 381, similar to the barrel axis 181 shown in FIG. 1, defined by the longitudinal axis of a barrel supported by the stock assembly 305 extends along the length of the stock assembly 305.

FIGS. 8 and 9 each include coordinate systems that are used for illustrative purposes in this description and to help clearly identify the different directions in which the cheek rest 322 may be adjusted to fit the preferences of a user. The side view shown in FIG. 8 includes the X-axis and the Y-axis, with the Z-axis extending into and out of the page. The top view shown in FIG. 9 illustrates the X-axis and the Z-axis, with the Y-axis extending into and out of the page. The directional term "front-to-back" indicates movement along the X-axis. The directional term "up-and-down" indicates movement along the Y-axis. The directional term "side-to-side" indicates movement along the Z-axis. For clarity of understanding, the barrel axis 381 runs parallel to the X-axis.

Figure 10:
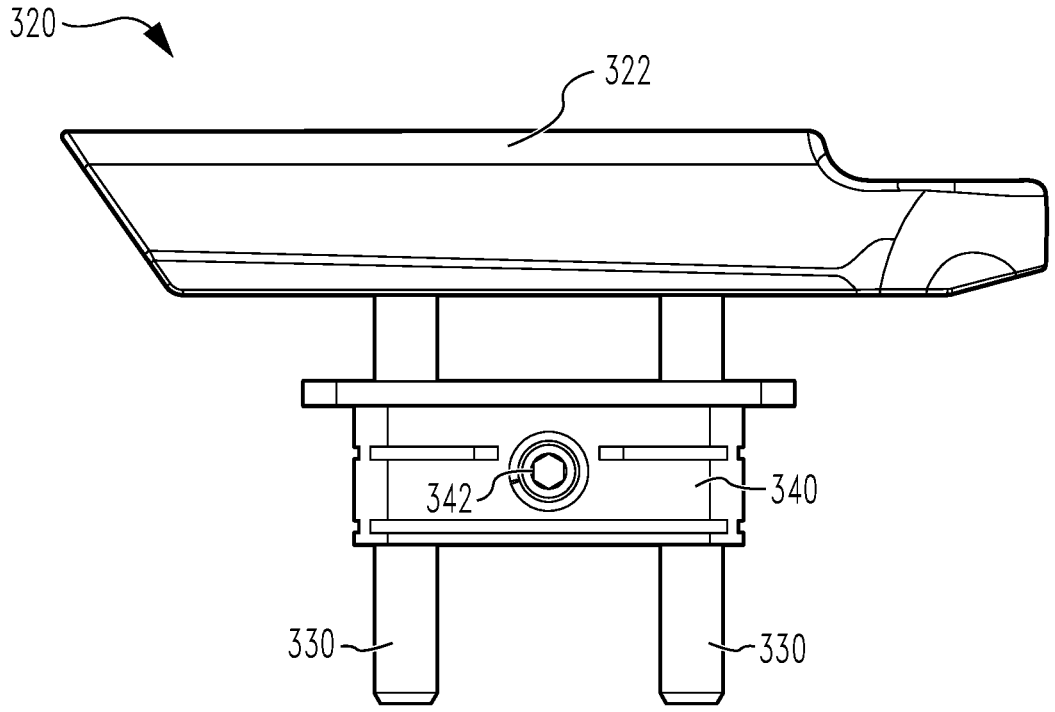
FIG. 10 is a right side view of a cheek riser of the stock assembly of FIG. 8.
Figure 11:
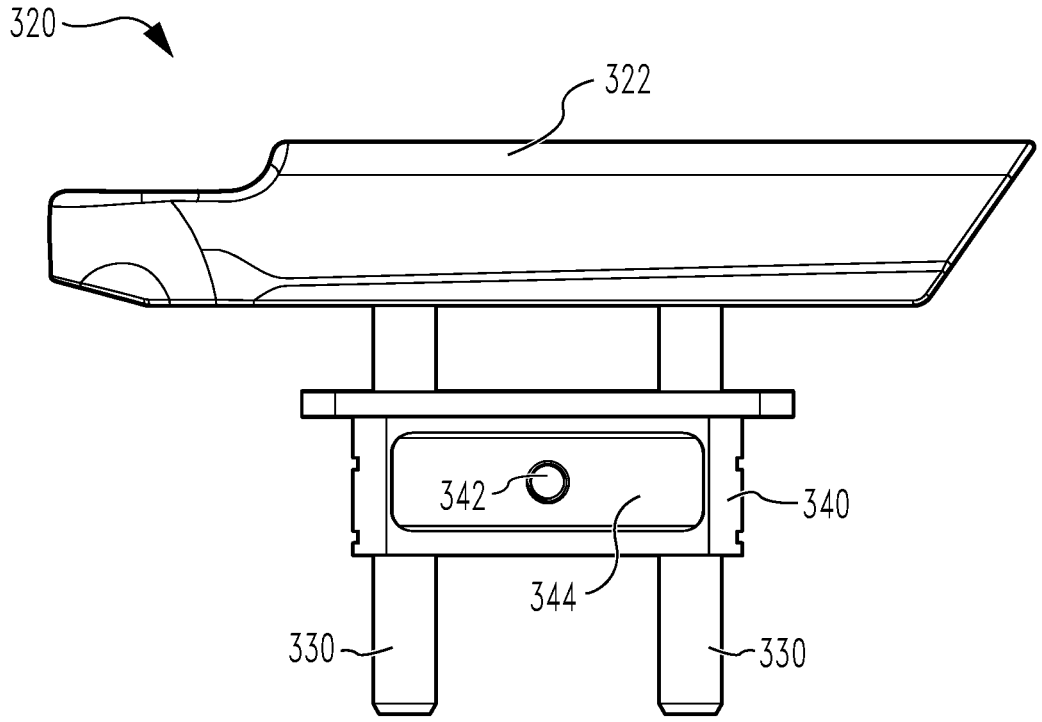
FIG. 11 is a left side view of the cheek riser of FIG. 10.

As shown in FIGS. 10 and 11, cheek riser 320 includes the cheek rest 322 and riser posts 330 that extend downward from cheek rest 322. The riser posts 330 extend through a buttstock insert 340 that spans the riser posts 330, such as through a riser post insert slot 341 (see FIG. 12) defined by the buttstock insert 340. The riser clamp 344 is coupled to the buttstock insert 340 by an adjustment fastener 342 and is positioned adjacent the riser posts 330 (see FIG. 11). In the embodiment shown in FIGS. 10 and 11, the adjustment fastener 342 is a threaded screw that may be inserted through a fastener opening defined through the buttstock insert 340 and threaded into a threaded opening defined through the riser clamp 344. Advantageously, by rotating the adjustment fastener 342, the riser clamp 344 can be moved towards or away from the riser posts 330 so as to apply or release a clamping force on the riser posts 330 and resist and/or permit movement of the riser posts 330 relative to the buttstock insert 340.

Figure 12:
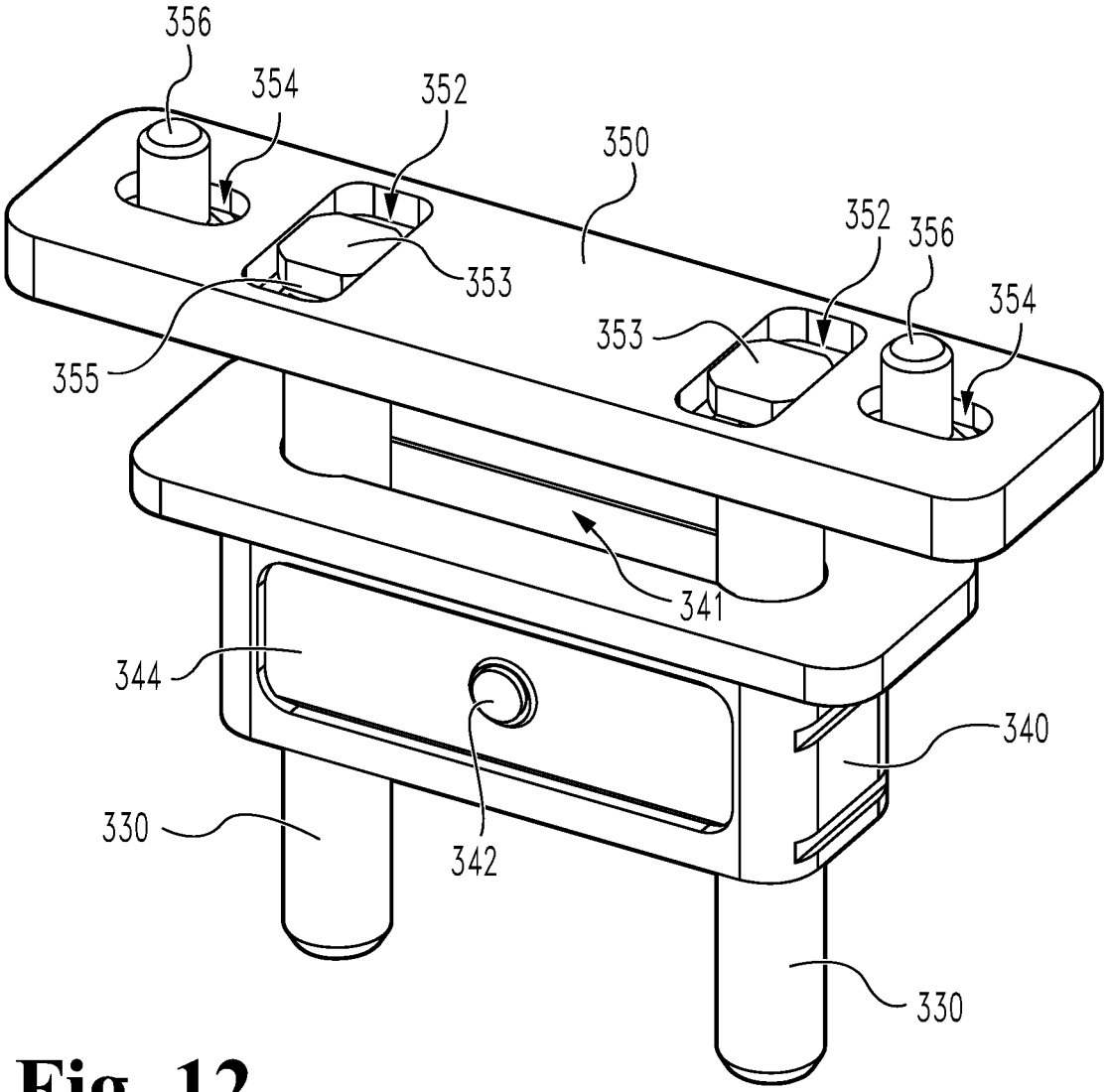
FIG. 12 is a perspective view of the cheek riser of FIG. 10 with the cheek rest of the cheek riser removed.

FIG. 12 illustrates a perspective view of the cheek riser 320 with the cheek rest 322 removed to provide a better view of the mechanism that is used to allow for adjustment of the position of the cheek riser 320 relative to the barrel axis 381. As shown, each of the riser posts 330 is connected to a cheek rest base 350 by a riser fastener 353 that extends through a riser slot 352 defined by the cheek rest base 350. The cheek rest base 350 has an elongate shape that includes a length, a width, and a thickness. The length of the cheek rest base 350 is greater than the width of the cheek rest base 350. The width of the cheek rest base 350 is greater than the thickness of the cheek rest base 350. The riser slots 352 defined by cheek rest base 350 may be oriented so that the greatest dimension of the riser slot 352 extends along the width of the cheek rest base 350.

Figure 13:
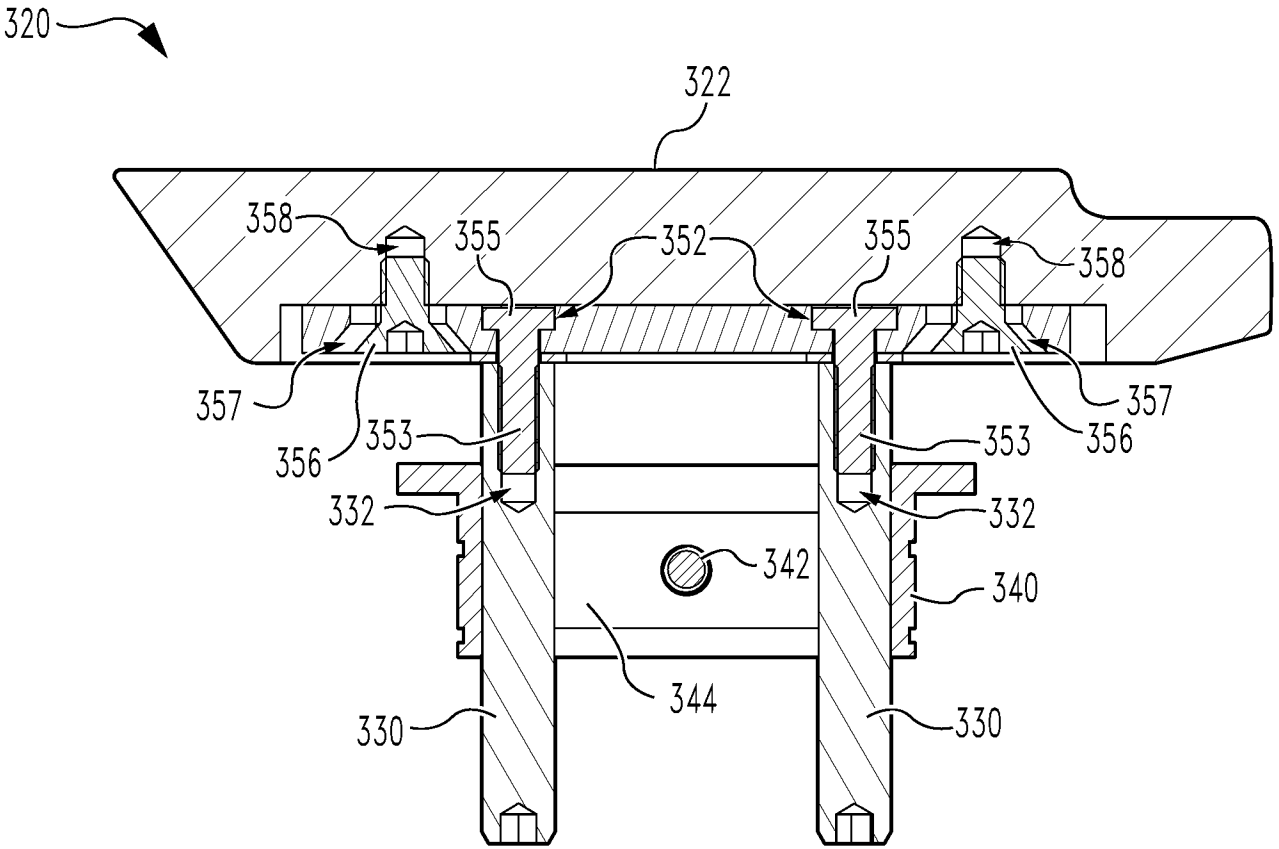
FIG. 13 is a cross-sectional side view of the cheek riser of FIG. 10.

The riser fastener 353 includes a head 355 and a body (see FIG. 13). The head 355 of the riser fastener 353 is positioned on the side of the cheek rest base 350 that is opposite the side of the riser post 330, which is connected to the cheek rest base 350 by the riser fastener 353. The head 355 has a polygonal periphery. As shown in the embodiment illustrated in FIG. 12, the head 355 may include two or more parallel sides if desired. The width of the riser slot 352 defined through the cheek rest base 350 is approximately equal to a distance between the two parallel sides of the polygonal periphery of the riser fastener 353 to allow the riser fastener 353 to fit within the riser slot 352.

In the embodiment shown, each of the riser posts 330 includes a riser fastener opening 332 (see FIG. 13) through the top surface of the riser post 330 that is configured to receive a riser fastener 353. In some embodiments, the riser fastener opening 332 in the riser post 330 may be a threaded opening and the riser fastener 353 may be a threaded fastener (e.g., a screw or bolt). Each of the riser slots 352 allows lateral adjustment of the riser post 330 and the riser fastener 353 relative to the cheek rest base 350.

Base fastener slots 354 are also defined by the cheek rest base 350. The base fastener slots 354 is oriented so that its greatest dimension lies along the length of the cheek rest base. Each base fastener slot 354 receives a base fastener 356 that extends through the base fastener slot 354. The base fastener 356 includes a base fastener head 357 that is positioned on the side of the cheek rest base 350 that is opposite of the cheek rest 322 when the cheek rest 322 is positioned on the cheek rest base 350 The base fastener 356 is able to move longitudinally within the base fastener slot 354, in a direction that is transverse to the riser slots 352. In some embodiments, the base fastener 356 may be a threaded hex screw. As illustrated in FIG. 13, each of the base fasteners 356 is inserted into a corresponding base fastener opening 358 that is defined by the cheek rest 322 to attach the cheek rest base 350 to the cheek rest 322.

Figure 14:
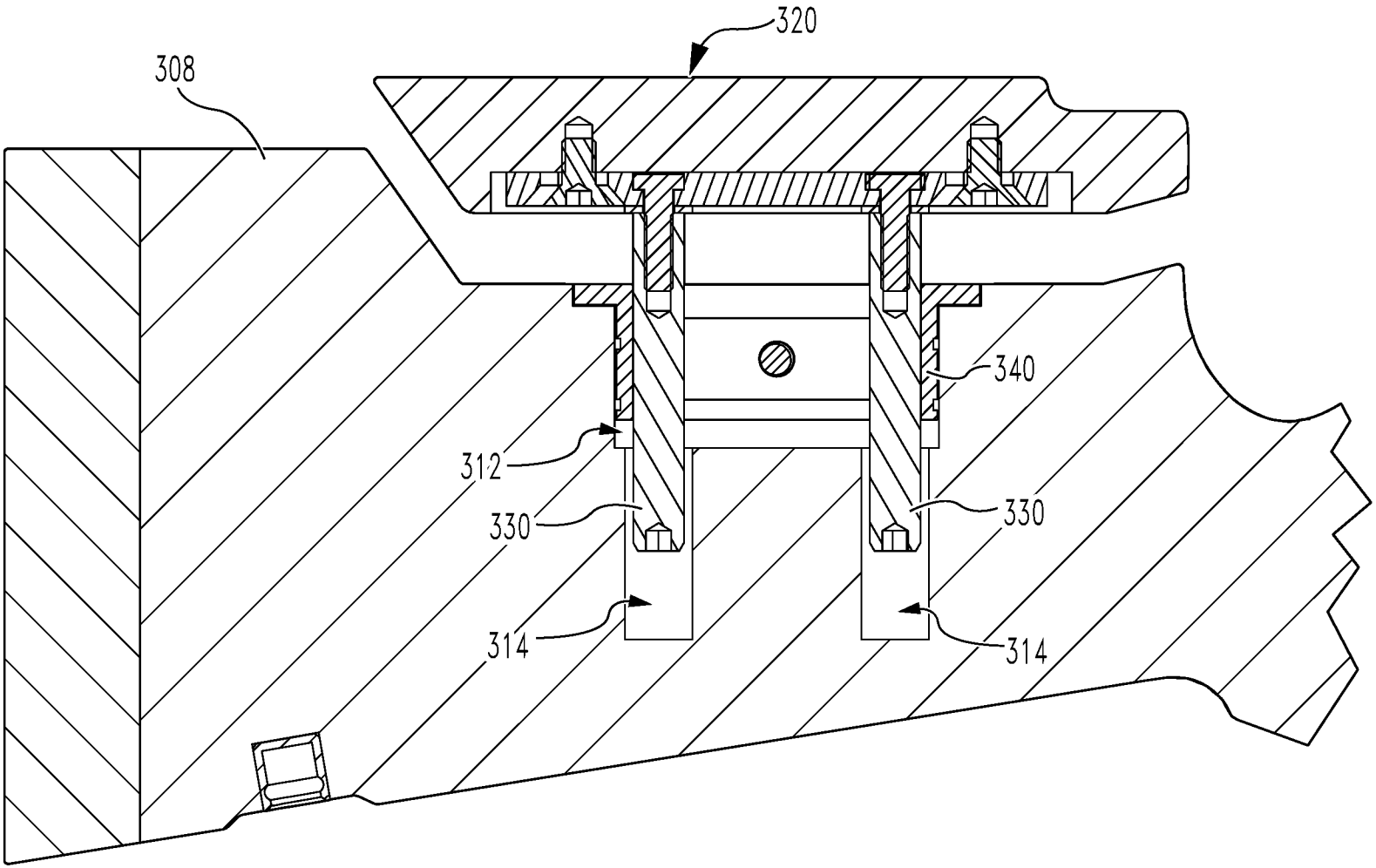
FIG. 14 is a partial cross-sectional view of the stock assembly of FIG. 8.

As shown in FIG. 14, a riser cavity 312 is defined in buttstock 308 and configured to receive the buttstock insert 340. One or more riser cavities 314 may also by defined in buttstock 308 and extend downward from riser cavity 312 to receive riser posts 330 of the cheek riser 320. The buttstock insert 340 is secured in riser cavity 312 with a friction and/or interference fit to allow the cheek riser 320 to be stable when in use, but also removable when desired.

The position of cheek rest 322 may be adjusted in at least four different directions by adjusting the position of the risers and fasteners in the various slots included in the cheek riser 320. As described in greater detail below, the position of the cheek rest 322 is independently variable up-and-down, from side-to-side, from front-to-back, and/or at different angles with respect to the barrel axis.

Up-and-down movement, or the height of the cheek rest 322, may be varied using the adjustment fastener 342 of the buttstock insert 340. The adjustment fastener 342 may be arranged in a loosened condition that releases the riser clamp 344 from securing the riser posts 330, allowing the riser posts 330 to slide vertically within riser cavities 314 defined in buttstock 308. In the embodiment shown, the adjustment fastener 342 is arranged in the loosened condition by unscrewing the adjustment fastener 342 from the threaded opening in the riser clamp 344. In other embodiments, other suitable methods of loosening the adjustment fastener 342 may be used to arrange the adjustment fastener 342 in the loosened condition.

Modifying the vertical position of the riser posts 330 within the riser cavities 314 changes the height of the cheek rest 322. For example, inserting the riser posts 330 farther into the riser cavities 314 causes the height of the cheek rest 322 to decrease, and decreasing the depth that the riser posts 330 are inserted into the riser cavities 314 causes the height of the cheek rest 322 to increase. Once the cheek rest 322 is positioned at a desired height, the adjustment fastener may arranged in a tightened condition to secure the riser clamp 344 against the riser posts 330 and resist the riser posts 330 from moving vertically with respect to the buttstock insert 340 and the buttstock 308. In the embodiment shown, the adjustment fastener 342 is arranged in the tightened condition by screwing the adjustment fastener 342 to tighten the riser clamp 344 to the riser posts 330. In any embodiments, other suitable methods of clamping the riser posts 330 may be used (e.g., cams, set screws, detents, etc.).

The amount of height adjustment allowed for cheek rest 322 may be defined by the depth of the riser cavities 314 and/or the length of the riser posts 330. Deeper riser cavities 314 and/or longer riser posts 330 can allow for greater height adjustment. In some embodiments, the depth of the riser cavities 314 and/or the length of the riser posts 330 may be configured to allow for the height of the cheek rest 322 to be adjusted up to 50 millimeters, up to 40 millimeters, or up to 30 millimeters.

Side-to-side movement of the cheek rest 322 is permitted by sliding the riser slots 352 along the riser posts 330 and the attached riser fasteners 353. The riser posts 330 remain stationary laterally and forward and aft within the buttstock 308 while each of the riser fasteners 353 is loosened from or removed from the respective riser post 330. Loosening the riser fastener 353 allows the cheek rest base 350 to move laterally by sliding the riser slot 352 along the riser posts 330. Once the cheek rest 322 is moved to the desired lateral position, the riser fasteners 353 are tightened to their respective riser posts 330 to secure the cheek rest base 350 to the riser posts 330 and prevent further lateral movement of the cheek rest 322.

The amount of side-to-side movement that is allowed may be defined by the width of the riser slots 352 and the riser fasteners 353. Increasing the width of the riser slots 352 and/or decreasing the width of the riser fasteners 353 in the cheek rest base 350 increases the distance of lateral or side-to-side adjustment that is allowed for the cheek rest 322. Decreasing the width of the riser slots 352 and/or increasing the width of the riser fasteners 353 decreases the distance for lateral adjustment of the cheek rest 322. In some embodiments, the lateral position of the cheek rest 322 may be adjusted over a range of up to 15 millimeters or up to 10 millimeters.

Front-to-back movement of the cheek rest 322, parallel to the direction of the barrel axis 381, is permitted by sliding the base fasteners 356 along the cheek rest base 350 within the base fastener slots 354. The base fasteners 356 can be loosened from the cheek rest 322 and the cheek rest base 350 to allow the base fasteners 356 to slide within the base fastener slots 354 to a desired position. When the cheek rest 322 is positioned as desired in the front-to-back direction, the base fasteners 356 are tightened to be held securely to the cheek rest base 350, resisting further sliding of the base fasteners 356 within the base fastener slots 354. When tightened to the cheek rest base 350, the base fasteners 356 extend into the base fastener openings 358 in the cheek rest 322 to secure the cheek rest 322 to the cheek rest base 350.

The amount of front-to-back movement that is allowed may be defined by the length of the base fastener slots 354 and the corresponding thickness of the base fasteners 356. Increasing the length of the slots and/or decreasing the thickness of the base fasteners can increase the distance of which the cheek rest 322 may be adjusted in the front-to-back direction. In some embodiments, the base fastener slots 354 and base fasteners 356 may have dimensions that allow the cheek rest 322 to be adjusted over a range of up to 10 millimeters or up to 6 millimeters.

The angle of the cheek rest 322 with the respect to the barrel axis 381 may be adjusted by changing the position of the riser posts 330 within the riser slot 352 in a similar process as the one described above for side-to-side adjustments. The riser posts, however, may be positioned in different locations of their respective riser slots. For example, one riser post may be positioned in a left-most area of its riser slot and the other riser post may be positioned in a right-most area of its riser slot. Advantageously, by positioning the riser posts at different horizontal locations within the respective riser slots 352 a desired angle of the cheek rest relative to the barrel axis may be achieved.

In one particular configuration, the front riser post 330 may be positioned on the left edge the corresponding riser slot 352 while the back riser post 330 may be positioned on the right edge of the corresponding riser slot 352. In this configuration, the front of the cheek rest 322 may be offset to the left side of the barrel axis 381 while the back of the cheek rest 322 may be offset to the right side of the barrel axis 381. In other arrangements, this configuration may be reversed so that the front riser post 330 is positioned on the right edge of the corresponding riser slot 352 while the back riser post 330 is positioned on the left edge of the corresponding riser slot 352. In these arrangements, the front of the cheek rest 322 may be offset to the right side of the barrel axis 381 while the back of the cheek rest 322 may be offset to the left side of the barrel axis 381.

In many embodiments, the cheek rest 322 may be inclined or declined relative to the barrel axis 381 by raising or lowering the riser posts 330. To create an inclined angle or a declined angle, the riser posts 330 may be arranged at different heights. The process of adjusting the height of a single riser post 330 is similar to the process used to adjust the height of the cheek rest 322 describe above. The adjustment fastener 342 may be loosened to allow the riser posts 330 to move vertically with respect to the riser clamp 344. Instead of modifying the height of both riser posts 330 equally, a user may change the height of one riser post 330 more or less than another to create a desired inclination or declination of the cheek rest 322. Once the desired angle is achieved, the adjustment fastener 342 is retightened to secure the riser clamp 344 to the riser posts 330 and resist further modification of the height of the riser posts 330.

The cheek rest may be configured for adjustment in all or only a subset of the directions discussed herein. For instance, in some arrangements the cheek rest may be configured for adjustment up/down, left/right, and forward/back but not configured for inclination/declination of the cheek rest 322 relative to the barrel axis 381. Similarly, the cheek rest may additionally or alternatively not be configured for lateral angular adjustment relative to the barrel axis (e.g., toeing the front or back of the cheek rest to one side or the other).

As used herein, the term "synthetic polymer" refers to any human-made polymer. Representative examples of synthetic polymers include thermoplastics such as nylon and Tenite.

As used herein, the term "composite" includes fiberglass, carbon fiber, graphite, graphine, Micarta® as marketed by Norplex-Micarta, and/or G-10.

The following numbered clauses set out specific embodiments that may be useful in understanding the present invention:

1. A stock for a firearm, comprising:
   a first material molded at least partially around an accessory attachment housing comprising a second material;
   said accessory attachment housing having a sidewall defining at least a portion of an internal cavity of said accessory attachment housing;
   said sidewall having an inward-facing surface facing said internal cavity, an outward-facing surface opposing said inward-facing surface, and a thickness extending from said inward-facing surface to said outward-facing surface;
   said sidewall defining a sidewall opening extending through said thickness; and
   said sidewall opening having a width less than a corresponding width of said internal cavity.
2. The stock of clause 1, wherein said first material of said stock covers said outward-facing surface.
3. The stock of any preceding clause, wherein said sidewall opening defines a length less than a corresponding length of said internal cavity.
4. The stock of any preceding clause, wherein said accessory attachment housing has a polygonal cross-section.
5. The stock of clause 4, wherein said sidewall opening is defined by a planar sidewall of said accessory attachment housing.
6. The stock of any preceding clause, wherein said internal cavity of said accessory attachment housing is free of said first material of said stock.
7. The stock of any preceding clause, wherein said first material is a synthetic polymer and said second material is a metal.
8. The stock of any preceding clause, wherein said first material is a laminate construct and said second material is metal.
9. The stock of clause 8, wherein said laminate construct comprises one or more layers of woven material.
10. The stock of clause 9, wherein said one or more layers of woven material comprise fiberglass and/or carbon fiber.
11. The stock of any preceding clause, wherein said opening is non-circular.
12. The stock of any preceding clause, wherein said opening is an elongate opening.
13. The stock of any preceding clause, wherein said opening of said accessory attachment housing is an M-LOK® opening.
14. The stock of any preceding clause, further comprising:
   a cheek riser including a cheek rest, said cheek rest attached to a cheek rest base, said cheek rest base attached to at least one riser post, and said at least one riser post attached to a buttstock of said stock;

wherein said cheek rest of said cheek riser is configured for translation relative to said cheek rest base in a first direction;

wherein said cheek rest base is configured for translation relative to said at least one riser post in a second direction;

wherein said at least one riser post is configured for translation relative to said buttstock in a third direction;

wherein said first direction is transverse to said second direction and said third direction; and wherein said second direction is transverse to said third direction.

15. A method of forming a component for a firearm, comprising:

positioning a hollow accessory attachment housing having an interior cavity into a mold; and molding a first material around said hollow accessory attachment housing; and forming at least one opening through a sidewall and into the interior cavity of said hollow accessory attachment housing; and wherein the at least one opening has a width less than a corresponding width of said interior cavity.

16. The method of clause 15, wherein said molding does not fill the interior cavity of said hollow accessory attachment housing with said first material.

17. The method of clause 15 or 16, wherein said forming at least one opening occurs after molding said first material around said hollow accessory attachment housing.

18. The method of clause 17, comprising forming at least one opening through said first material; and wherein said at least one opening through said first material aligns with said at least one opening of said sidewall of said hollow accessory attachment housing so as to allow access through said first material and said sidewall into said interior cavity of said hollow accessory attachment housing.

19. The method of clause 18, wherein said forming at least one opening through said first material occurs prior to said forming at least one opening through said sidewall.

20. The method of claim 15, wherein said forming at least one opening in said sidewall includes milling said sidewall.

21. The method of any one of clauses 15-20, wherein said first material comprises carbon fiber.

22. The method of any one of clauses 15-21, wherein said accessory attachment housing comprises metal.

23. The method of any one of clauses 15-22, wherein the component is a firearm stock.

24. The method of any one of clauses 15-23, wherein said at least one opening in said sidewall is an M-LOK® opening.

25. A stock assembly for a firearm comprising:

a buttstock;

a cheek riser including a cheek rest, said cheek rest attached to a cheek rest base, said cheek rest base attached to at least one riser post, and said at least one riser post attached to said buttstock;

wherein said cheek rest of said cheek riser is configured for translation relative to said cheek rest base in a first direction;

wherein said cheek rest base is configured for translation relative to said at least one riser post in a second direction;

wherein said at least one riser post is configured for translation relative to said buttstock in a third direction;

wherein said first direction is transverse to said second direction and said third direction; and wherein said second direction is transverse to said third direction.

26. The stock assembly of clause 25, wherein said first direction is parallel to a barrel axis of the firearm.

27. The stock assembly of clause 25 or 26, wherein a fastener securing said cheek rest to said cheek rest base has a head positioned on a side of said cheek rest base opposite a side of said cheek rest base facing said cheek rest.

28. The stock assembly of clause 27, wherein said fastener securing said cheek rest to said cheek rest base extends through an elongate slot defined by said cheek rest base.

29. The stock assembly of clause 28, wherein said cheek rest base has a length, a width, and a thickness, said length greater than said width and said width greater than said thickness; and wherein said elongate slot receiving said fastener securing said cheek rest to said cheek rest base has a greatest dimensions extending along said length of said cheek rest base.

30. The stock assembly of any one of clauses 25-29, wherein a fastener securing said at least one riser post to said cheek rest base has a head positioned on a side of said cheek rest base opposite a side of said cheek rest base facing said at least one riser post.

31. The stock assembly of clause 30, wherein said fastener securing said at least one riser post to said cheek rest base extends through an elongate slot defined by said cheek rest base.

32. The stock assembly of clause 31, wherein said cheek rest base has a length, a width, and a thickness, said length greater than said width and said width greater than said thickness; and wherein said elongate slot receiving said fastener securing said cheek rest base to said at least one riser post has a greatest dimensions extending along said width of said cheek rest base.

33. The stock assembly of clause 30, wherein said head of said fastener securing said at least one riser post to said cheek rest base has a polygonal periphery with at least two parallel sides.

34. The stock assembly of clause 33, wherein said cheek rest base defines a slot for receiving said head of said fastener securing said at least one riser post to said cheek rest base; and wherein said slot has a width approximately equal to a distance between said at least two parallel sides of said head.

35. The stock assembly of any one of clauses 25-34, wherein said at least one riser post extends through a buttstock insert having a clamp configured to selectively resist movement of the at least one riser post relative thereto; and wherein said buttstock insert is secured within said buttstock.

36. The stock assembly of any one of clauses 25-35, wherein said cheek rest base is at least partially rotatable around said third direction.

37. The stock assembly of any one of clauses 25-36, wherein said first direction and second directions are orthogonal to said third direction.

38. The stock assembly of any one of clauses 25-37, wherein said first direction is orthogonal to said second direction.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A stock for a firearm, comprising:

a first molded material molded at least partially around an accessory attachment housing comprising a second material;

said accessory attachment housing having a top side, a bottom side opposite said top side, a first lateral side, and a second lateral side opposite said first lateral side, wherein said first molded material contacts said top side, said bottom side, said first lateral side, and said second lateral side of said accessory attachment housing;

said bottom side of accessory attachment housing having a sidewall defining at least a portion of an internal cavity of said accessory attachment housing;

said sidewall having an inward-facing surface facing said internal cavity, an outward-facing surface opposing said inward-facing surface, and a thickness extending from said inward-facing surface to said outward-facing surface;

said sidewall defining a sidewall opening extending through said thickness; and said sidewall opening having a width less than a corresponding width of said internal cavity.

2. The stock of claim 1, wherein said first molded material of said stock completely covers said outward-facing surface.

3. The stock of claim 1, wherein said sidewall opening defines a length less than a corresponding length of said internal cavity.

4. The stock of claim 1, wherein said internal cavity of said accessory attachment housing is free of said first molded material of said stock.

5. The stock of claim 1, wherein said first molded material is a synthetic polymer and said second material is a metal.

6. The stock of claim 1, wherein said first molded material is a laminate construct and said second material is metal.

7. The stock of claim 6, wherein said laminate construct comprises one or more layers of woven material.

8. The stock of claim 7, wherein said one or more layers of woven material comprise fiberglass and/or carbon fiber.

9. The stock of claim 1, further comprising:

a cheek riser including a cheek rest, said cheek rest attached to a cheek rest base, said cheek rest base attached to at least one riser post, and said at least one riser post attached to a buttstock of said stock;

wherein said cheek rest of said cheek riser is configured for translation relative to said cheek rest base in a first direction;

wherein said cheek rest base is configured for translation relative to said at least one riser post in a second direction;

wherein said at least one riser post is configured for translation relative to said buttstock in a third direction;

wherein said first direction is transverse to said second direction and said third direction; and wherein said second direction is transverse to said third direction.

10. The stock of claim 9, wherein said first direction is parallel to a barrel axis of the firearm.

11. The stock of claim 9, wherein a fastener securing said cheek rest to said cheek rest base has a head positioned on a side of said cheek rest base opposite a side of said cheek rest base facing said cheek rest.

12. The stock of claim 9, wherein a fastener securing said at least one riser post to said cheek rest base has a head positioned on a side of said cheek rest base opposite a side of said cheek rest base facing said at least one riser post.

13. The stock of claim 9, wherein said at least one riser post extends through a buttstock insert having a clamp configured to selectively resist movement of the at least one riser post relative thereto; and wherein said buttstock insert is secured within a buttstock of the firearm.

14. The stock of claim 1, wherein said internal cavity has a height measured along a direction extending between said top and bottom sides of said accessory attachment housing; and wherein said height of said internal cavity is less than a width and a length of said internal cavity.

15. The stock of claim 1, wherein said sidewall opening is a first sidewall opening;

wherein said sidewall further defines a second sidewall opening spaced from said first sidewall opening along a length of the accessory attachment housing; and wherein said first molded material extends along the outward-facing surface between the first sidewall opening and the second sidewall opening.

16. A stock for a firearm, comprising:

a first material molded at least partially around an accessory attachment housing comprising a second material; and a cheek riser including a cheek rest, said cheek rest attached to a cheek rest base, said cheek rest base attached to at least one riser post, and said at least one riser post attached to a buttstock of said stock;

said accessory attachment housing having a sidewall defining at least a portion of an internal cavity of said accessory attachment housing;

said sidewall having an inward-facing surface facing said internal cavity, an outward-facing surface opposing said inward-facing surface, and a thickness extending from said inward-facing surface to said outward-facing surface;

said sidewall defining a sidewall opening extending through said thickness;

said sidewall opening having a width less than a corresponding width of said internal cavity;

wherein said cheek rest of said cheek riser is configured for translation relative to said cheek rest base in a first direction;

wherein said cheek rest base is configured for translation relative to said at least one riser post in a second direction;

wherein said at least one riser post is configured for translation relative to said buttstock in a third direction;

wherein said first direction is transverse to said second direction and said third direction; and wherein said second direction is transverse to said third direction.

17. The stock of claim 16, wherein said first direction is parallel to a barrel axis of the firearm.

18. The stock of claim 16, wherein a fastener securing said cheek rest to said cheek rest base has a head positioned on a side of said cheek rest base opposite a side of said cheek rest base facing said cheek rest.

19. The stock of claim 16, wherein a fastener securing said at least one riser post to said cheek rest base has a head positioned on a side of said cheek rest base opposite a side of said cheek rest base facing said at least one riser post.

20. The stock of claim 16, wherein said at least one riser post extends through a buttstock insert having a clamp configured to selectively resist movement of the at least one riser post relative thereto; and wherein said buttstock insert is secured within a buttstock of the firearm.

* * * * *